United States Patent [19]

Herman

[11] 4,014,463

[45] Mar. 29, 1977

[54] PLURAL COMPONENT DISPENSER

[75] Inventor: Paul F. Hermann, Andover, Mass.

[73] Assignee: Kenics Corporation, North Andover, Mass.

[22] Filed: Nov. 28, 1975

[21] Appl. No.: 636,156

[52] U.S. Cl. ..... 222/145

[51] Int. Cl.[2] ..... B67D 5/60

[58] Field of Search ..... 222/326, 327, 136, 137, 222/135, 145, 391, 138–140, 386, 390, 389; 259/4 R, 4 AC

[56] References Cited

UNITED STATES PATENTS

| | | | |
|---|---|---|---|
| 1,626,487 | 4/1927 | Warren | 259/4 R |
| 2,000,953 | 5/1935 | Hooker et al. | 259/4 R |
| 3,117,696 | 1/1964 | Herman et al. | 222/390 X |
| 3,144,966 | 8/1964 | Cook | 222/327 X |
| 3,189,226 | 6/1965 | Sherbondy | 222/327 X |
| 3,296,803 | 1/1967 | Kroekel | 222/136 X |
| 3,311,265 | 3/1967 | Creighton, Jr. et al. | 222/137 |
| 3,587,982 | 6/1971 | Campbell | 222/145 X |

*Primary Examiner*—Stanley H. Tollberg
*Assistant Examiner*—Norman L. Stack
*Attorney, Agent, or Firm*—Russell & Nields

[57] ABSTRACT

A dispenser for mixing and dispensing two reactive fluids, such as a resin and a hardener. The dispenser is comprised of two rugged chambers, each filled with one of the fluids and having a piston movable through the operable length of its chamber to force the fluids out through exit ports in said chamber directly into a mixer which mixes the fluids in a complete and highly ordered manner. The chambers are provided with common means to move the pistons synchronously through the chambers whose cross sectional dimensions are predetermined to cause a predetermined volumetric ration of the fluids to be delivered to the mixer.

7 Claims, 7 Drawing Figures

PLURAL COMPONENT DISPENSER

BACKGROUND OF THE INVENTION

This invention relates to the art of dispensing a plurality of fluid materials which, when mixed together, react with each other to produce a desired end product, such as an adhesive, potting compound, sealer, encapsulant or the like. The prior art has provided a number of devices in which two reactive materials are kept apart from each other and are mixed together prior to being discharged from the device for their desired end use. However, such prior art devices have failed fully to recognize the importance of exactitude in volumetric metering of the component materials in correct proportions; of complete separation of such components until they are mixed immediately prior to being discharged from the device; and of a highly ordered mixing of the components to insure complete uniformity of the discharged mixture.

SUMMARY OF THE INVENTION

The present invention provides a novel dispenser which greatly increases the effectiveness of dispensing a plurality of reactive fluid materials in those areas in which, as pointed out above, the prior art has been deficient. It comprises two separate sealed chambers, one of which is filled with one of the fluids and the other with the other. Each of the chambers is provided with a movable piston which, when moved through any given distance, will discharge an exactly predetermined volume of the fluid from its chamber. These chambers are assembled in a combined structure in which the pistons are connected to each other so that motion of one piston will produce a simultaneous motion of the other piston and in which the distances of travel of the two pistons are related to each other in a fixed predetermined ratio. As the two fluid components issue from their respective chambers they pass directly into a mixing structure which mixes the two components in a highly ordered, non-turbulent manner such that the mixture which issues from the mixing structure will be highly uniform both in the proportions of the two fluids but also in the statistical history of the rates at which the two components are blended with each other as they pass through the mixing structure.

The dispenser structure is provided with sealing devices such that the two components are kept completely separated from each other during shipping and in use until both components have passed into the confines of the mixing structure. Where it is not intended to discharge the entire contents of the two chambers in a single continuous discharge operation, the mixing structure is preferably replaceable so that it may be removed after each separate discharge operation and replaced by a fresh mixing structure in order to insure that the two components never come into contact with each other until and except while being subject to the mixing action of the mixing structure.

Various means for actuating the pistons are described so that the dispenser may be operated for small intermitted shots of for continuous complete discharges with any desired viscosities of the fluid components.

DETAILED DESCRIPTION OF PREFERRED EMBODIMENTS

Figure 1:
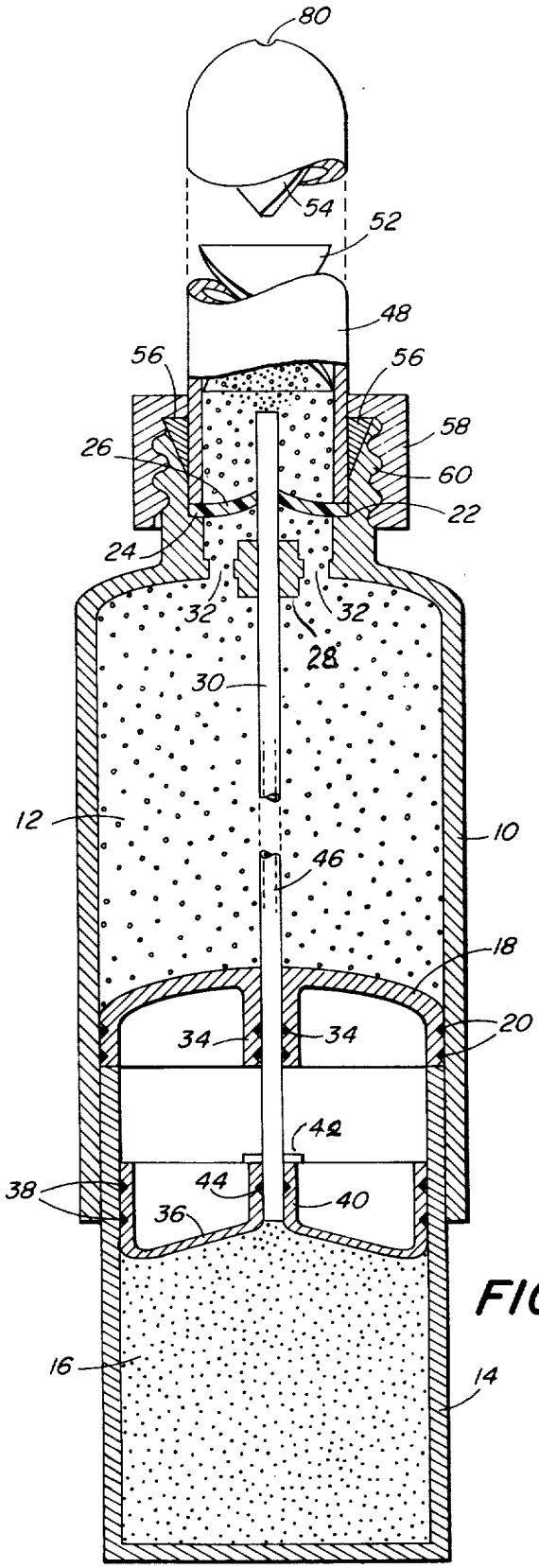
FIG. 1 is a vertical cross-section of a preferred embodiment of the dispenser of this invention.

FIG. 1 shows a dispenser comprising a chamber 10 preferebly molded of an inexpensive plastic material and adapted to contain one of the reactive fluids to be dispensed. This component, represented at 12, may be a resin such as one of the epoxies, polyurethanes, polyesters, silicones in liquid form. The dispenser also comprises a second chamber 14 adapted to contain any well known hardener 16 which, when mixed with the resin 12 causes the resin to polymerize and harden. Chamber 10 is open at its lower end into which is inserted a piston 18 fitting closely within the side walls of chamber 10 and provided with sealing devices such as 0 rings 20 which prevent leakage of the resin 12 past these sealing devices. The upper portion of chamber 10 is provided with a neck 22 having a shoulder 24 against which is seated a flexible sealing disc 26. The chamber 10 is also provided with a perforated bridge 28, at the base of neck 22 to support a hollow tube 30. The upper end of hollow tube 30 is forced through sealing disc 26 so that the disc not only provides a seal around the seat 24 but also around the hollow tube 30 so that the liquid resin 12 which passes through the openings 32 in bridge 28 cannot escape from chamber 10 until forced out by the pressure produced by motion of the piston 18 as will be explained below. The lower portion of hollow tube 30 passes through the piston 18 which is adapted to slide along tube 30. Piston 18 is also provided with sealing devices such as O rings 34, so that none of the resin 12 can leak past such sealing devices dispite any pressure which may be created whithin the resin 12 by motion of the piston 18.

Chamber 14 is open at its upper end into which is inserted a piston 36 fitted closely within chamber 14 and provided with a sealing device, such as O rings 38, which prevent leakage of the hardener 16 past these sealing devices. Chamber 14 is provided with a central hollow tube 40 through which the hardener 16 may flow. The chamber 14 telescopically fits snugly within the lower end of chamber 10, until the upper edge of the side wall of chamber 14 contacts the lower edge of the side wall of piston 18. At the same time, the lower end of hollow tube 30 slides into the hollow tube 40 until a stop member 42 secured to the tube 30 contacts the upper end of tube 40. Tube 40 is preferably provided with a sealing 0 ring 44 so that hardener 16 may flow freely through the central passage 40 of tube 30 without leaking around the outside of the tube 30.

During use, the dispenser is provided with a mixer 48 comprising a hollow tube 50 and a plurality of mixing elements 52, 54 to be described in greater detail with reference to FIG. 4. The lower end of the mixer tube 50 is forced down upon the rim of sealing disc 26 and is held firmly in position by tapered ferrules forced into the tapered upper end of neck 22 by a nut threaded into external threads 60 formed on the exterior of neck 22.

Figure 3:
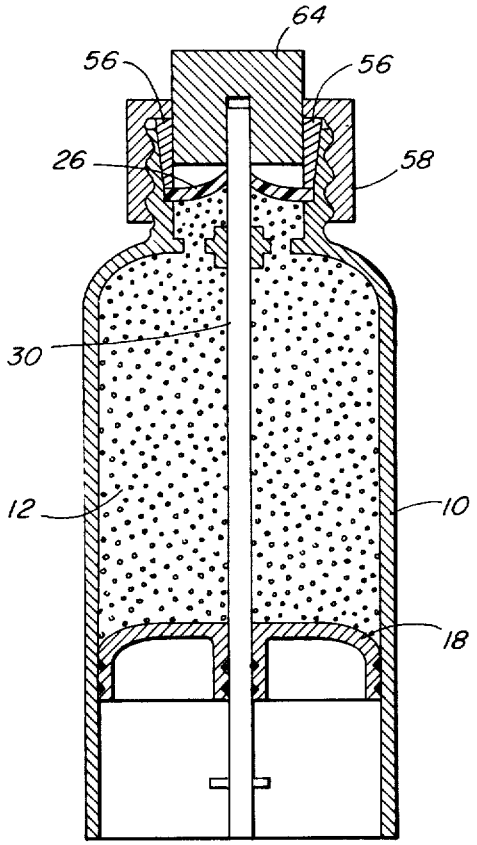
FIG. 3 is a similar cross-section of the other of the chambers also as prepared for shipment and storage.
Figure 2:
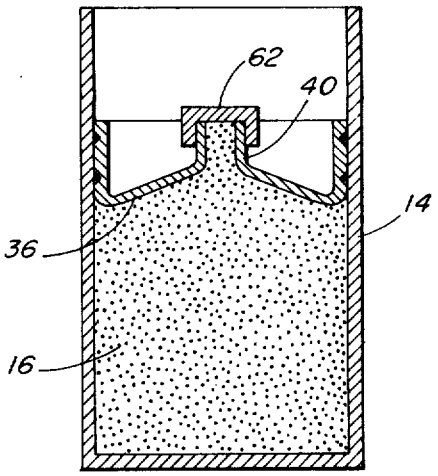
FIG. 2 is a similar cross-section of one of the chambers of the dispenser as it is prepared for shipment and storage.

Before entering upon a detailed description of the operation of the embodiment of FIG, 1, reference will be had to FIGS. 2, 3, 4 and 5. FIGS. 2 and 3 show the state of chambers 14 and 16 respectively after they have been filled and are ready to be shipped. As indicated, these chambers are filled separately and kept apart until they are ready to be assembled and used in the dispenser structure described in FIG. 1. As shown in FIG. 2, the material 16 in chamber 14 is prevented from escaping through tube 40 by a removable cap 62, sealed temporarily on the outer end of tube 40. As shown in FIG. 3, the chamber 10, when first filled with its liquid resin 12, does not carry the mixer 48 of FIG. 1, but instead is supplied with a plug 64, retained in place by nut 58 and ferrules 56 in substantially the same way as these elements retain mixer 48 in FIG. 1. The chambers 10 and 14 are maintained separately as shown in FIGS. 2 and 3 until it is desired to dispense the materials with which they are filled. It should be noted that with this arrangement there is not chance for the material from these chambers to come into contact with each other during such a separated condition. This is of special significance in the case of the more highly reactive materials which cause solidification very rapidly upon contact with each other.

Figure 4:
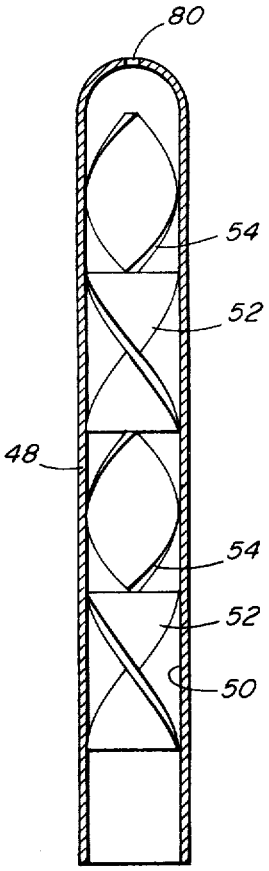
FIG. 4 is a cross-section of a replacable mixer to be used in the dispenser.

The other element, of the combination shown in FIG. 1, is the mixer 48 as shown in FIG. 4. While other appropriate mixers may be used, the prefered mixer is of the type here illustrated. Such mixer, described and claimed in U.S. Pat. No. 3,286,992. As previously indicated such a mixer comprises a hollow tube 50 containing a series of mixing elements 52 and 54. Each of these elements comprises a curved sheet-like helical member twisted so that its leading edge is at a substantial angle with respect to its trailing edge. Also the leading and trailing edges adjacent members are disposed at a substantial angle with respect to each other. The mixer is assembled with a successive of right and left handed helical members so that the direction of rotation of the fluids flowing past them are successively reversed. In FIG. 4 elements 52 are shown as left-handed helices and elements 54 as right-handed helices. The materials with which we are here concerned with are usually of substantial viscosity and are flowed past the mixing elements with laminar flows. Under these conditions a highly ordered mixing of the fluid components occurs so that not only are the components throughly mixed, but the resultant product possesses a very high degree of uniformity throughout.

When it is desired to use the components shown in FIG. 2, 3, and 4, they are assembled as shown in FIG. 1. The cap 62 of FIG. 2 is removed and the chamber 14 is inserted into chamber 10 so that the lower end of tube 30 fits into the tube 40. Preferably such insertion stops when stop 42 contacts tube 40 and the adjacent ends of chamber 14 and piston 18 touch each other. Plug 64 of FIG. 3 is removed and the mixer 48 of FIG. 4 is substituted for it, as shown in FIG. 1.

Figure 5:
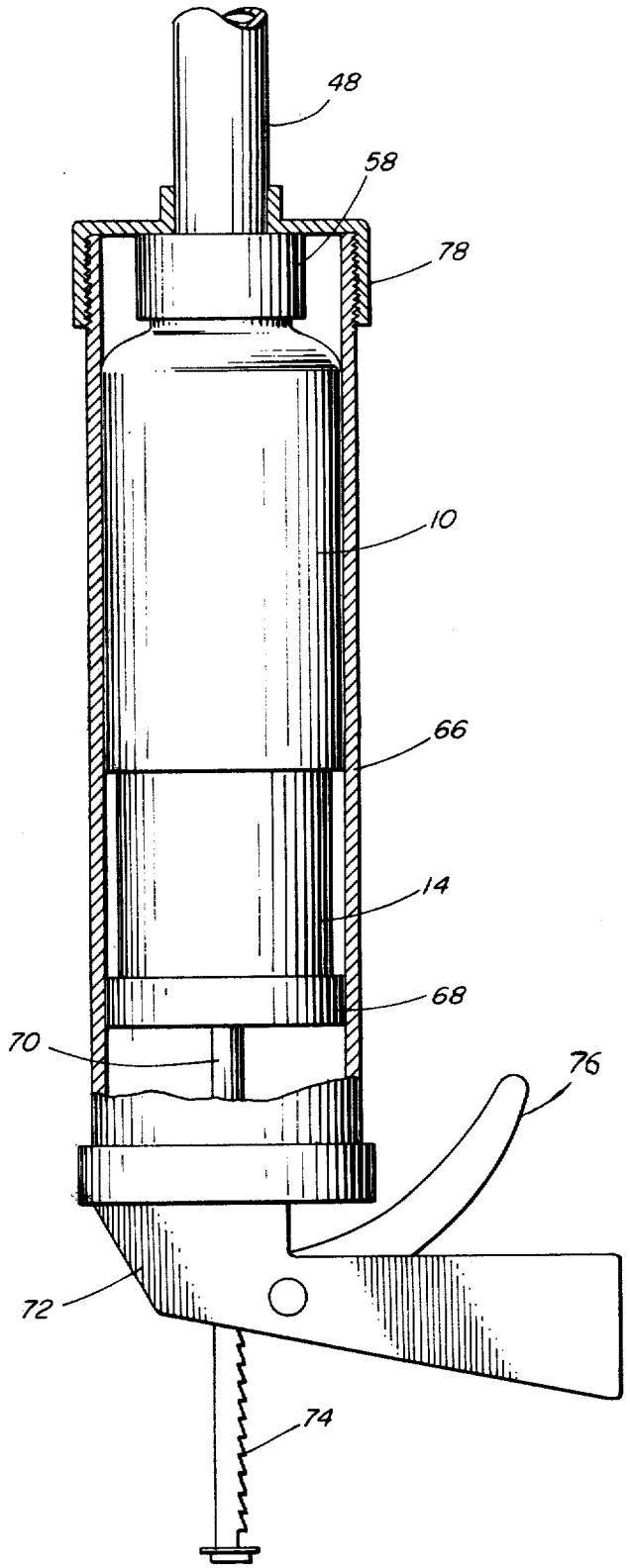
FIG. 5 is a view, partly in section, of the dispenser of FIG. 1 disposed in a conventional gun-type dispenser operator.

To operate the dispenser, force is exerted between chambers 10 and 14 to move chamber 14 further into chamber 10. While any convenient means for exerting such force may be used, one arrangement is shown in FIG. 5, which utilizes a typical caulking gun-type structure, the details of which are well known and need not be described here. In general, it comprises a cylindrical barrel 66 containing a plunger 68 which is moved within its barrel by a rod 70, extending through a handle 72 and being provided with a trigger 76 which, by its well known mechanism (not shown), advances the plunger 68 through a predetermined distance each time the trigger 76 is squeezed by the operator. The assembled chambers 10 and 14 are inserted into the barrel 66 until the bottom of the chamber 14 rests on the plunger 68. The assembled chambers are retained within the barrel 66 by a cap 78 threaded onto the upper end of barrel 66.

The operation of the dispenser may be best understood by referring to FIG. 1. As the chamber 14 is moved within the chamber 10, its upper end moves the piston 18 which exerts pressure on the resin 12. The pressure in turn, is exerted through openings 32 against the sealing disc 26 which flexes to open a passage for the resin 12 around the hollow tube 30. This the sealing disc acts as a valve member which opens and closes as pressure from the resin rises above and drops below predetermined limits. At the same time, the stop member 42 holds the piston 36 from moving upwardly with the chamber 14 so that piston 36 is forced downwardly with respect to chamber 14. This exerts pressure on the hardener 16 which is forced upwardly through the central passage 46 within tube 30 and which is ejected from the upper end of tube 30 directly into the mixing elements of mixer 48. Thus resin 12 and hardener 16 flow through the mixer 48 where they are subjected to the mixing action described above and from which the uniform mixture of resin and hardener issue through an exit port 80 at the end of mixer 48.

Figure 6:
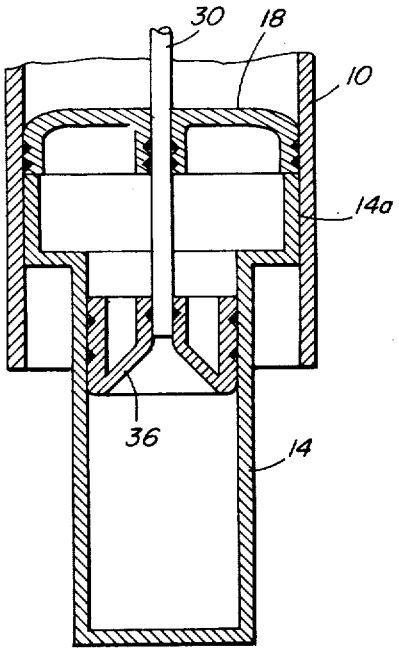
FIG. 6 is a partial view, on a reduced scale, of a modification of FIG. 1 showing a variation in the relative diameters of the two chambers.

The volumetric ratio between the resin and hardener is predetermined by the physical dimensions of the inside diameters of the chambers 10 and 14, which respectively determine the diameters of pistons 18 and 36. If, for example, the inside volumes of chambers 10 and 14 are equal, then exactly equal volumes of resin 12 and hardener 16 will be delivered to mixer 48 for each unit of linear motion of chamber 14 relative to chamber 10. Changing one or both of these diameters will provide any desired volumetric ratio. It is entirely possible to provide ratios which range from one to one to a hundred to one. A diagrammatic illustration of a variation in the inside diameter of chamber 14 is shown in FIG. 6 in which the reduced chamber 14 is provided with one enlarged upper end to engage the lower edge of piston 18. Once the volumetric ratio as established it remains constant throughout the entire length of stroke both for small intermittant shots or for a stroke which completely dispenses the contents of chambers 10 and 14. Thus the volumes of both fluid components are simultaneous metered independently of shot size or viscosity.

In the case where dispensing is halted short of complete discharge, pressure of the resin 12 against sealing disc 26 is relieved and that disc reseals itself around tube 30. Thus the contents of the chambers 10 and 14 are prevented from migrating from one chamber to the other so that the integrity of the separation of the fluid components is preserved. Under this condition, the materials within the mixer 48 may harden. In such case the mixer is removed and discarded. Thus the small quantity of fluids which may be left above the sealing disc 26 may be cleaned out before any significant amount of hardener reaches the resin. When it is desired to resume the dispensing operation, a fresh mixer 48 is inserted and the dispensing proceeds as before.

The entire dispenser may be molded from inexpensive plastic materials so that, when it has been emptied of its contents, it may be discarded.

Figure 7:
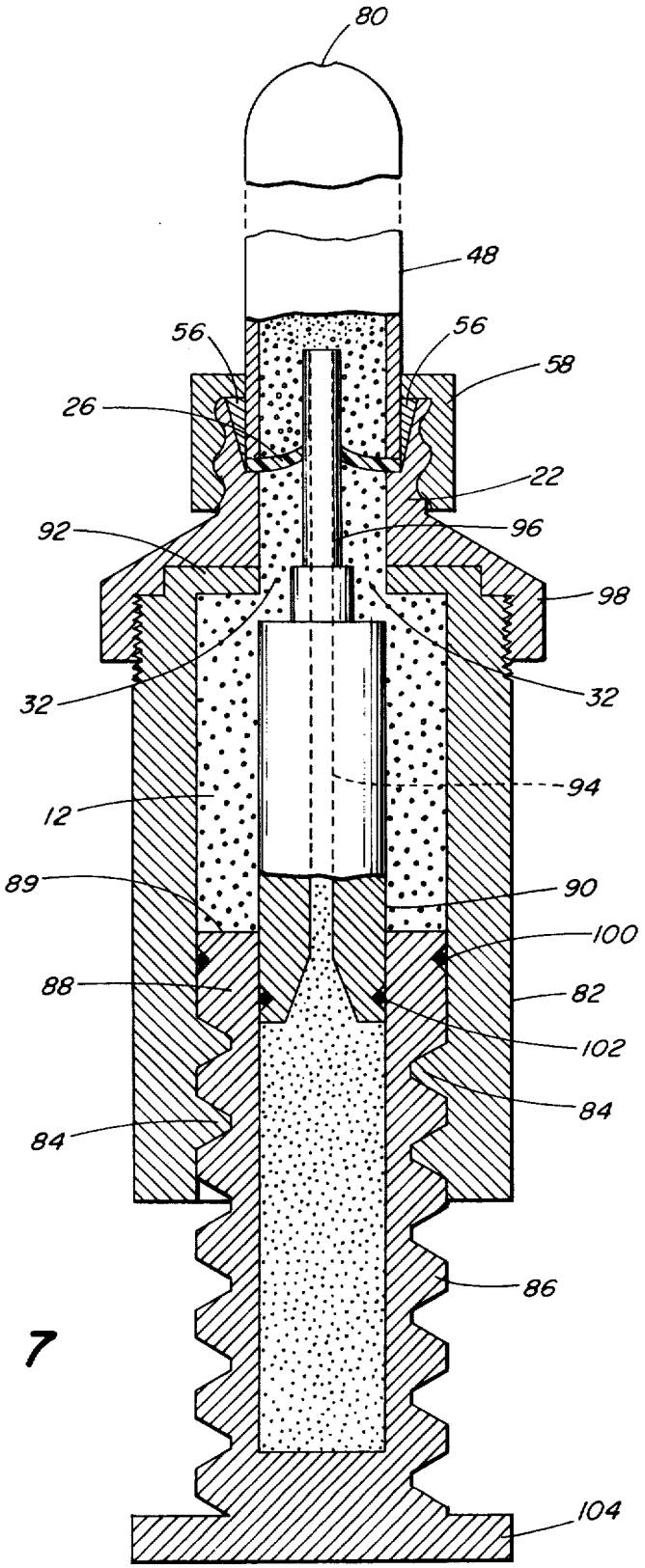
FIG. 7 is a cross-section, similar to that in FIG. 1, of another embodiment of the invention.

It is to be understood that the structures described above represent preferred embodiments of the invention and that various modifications may be made within the scope of the appended claims. For example, the linear force required to operate the dispenser may be applied merely by physically pushing the parts together Manually, pneumatically (as by an aerosal can), hydramatically, or by means of threading the parts into one another. An example of the latter is shown in the embodiment shown in FIG. 7 in which the parts which are the same as in FIG. 1 bear the same reference numerals. In the embodiment of FIG. 7, the resin 12 is contained with a chamber 82 provided with screw threads 84 which mesh with the screw threads 86 formed on the outside of a chamber 88 which is filled with the hardener 16. In this case the upper end 89 of the chamber 88 itself acts as the piston for the chamber 82. A cylindrical block 90, supported by a perforated bridge 92 serves as the piston for the chamber 88. A central passage 94, (similar to passage 46 of FIG. 1) passes through the block 90 and through a hollow tube extension 96 of the block 90. In this case the threaded neck 22 is formed integrally with a screw threaded cap 98 which is threaded into the upper end of chamber 82. O rings 100 and 102 are provided for sealing purposes similar to the O rings of FIG. 1. Relative motion of the chamber as produced by rotation the chamber 88 by means of a head 104 at its lower end. The threaded relationship between the two chambers produces the desired linear motion of the parts. In view of the operation as described in FIG. 1, it is believed that the operation of the embodiment of FIG. 7 will be obvious.

Dispensers constructed according to this invention may be used to mix and dispense any fluid two component materials such as adhesives, pharmaceuticals, cosmetics, foods and other chemicals. Various other uses and modifications of the invention will suggest themselves to those skilled in the art.

What is claimed is:

1. A plural component dispenser comprising:

a. two rigid chambers each having a uniform transverse area along its operable length;

b. a rigid piston spanning said transverse area in each of said chambers, each piston being movable along said chamber throughout said operable length;

c. common operating means related to both of said pistons and adapted to move both of said pistons synchromously along their respective chambers;

d. each of said chambers containing a fluid to be dispensed;

e. each of said chambers being provided with an exit port through which its fluids are ejected upon motion of the piston in said chamber;

f. a mixer connected to said dispenser, said mixer having an input end and a discharge end;

g. said ports being located closely adjacent said input end of said mixer;

h. said mixer comprising a hollow conduit containing a plurality of serially disposed of helical sheet-like elements, each of which has its trailing edge at a substantial angle with respect to its leading edge, the leading and trailing edges of adjacent elements being at a substantial angle with respect to each other and successive elements being curved in opposite senses.

2. A plural component dispenser comprising:

a. two rigid chambers each having a uniform transverse area along its operable length;

b. a rigid piston spanning said transverse area in each of said chambers, each piston being movable along said chamber throughout said operable length;

c. common operating means related to both of said pistons and adapted to move both of said pistons synchromously along their respective chambers;

d. each of said chambers containing a fluid to be dispensed;

e. each of said chambers being provided with an exit port through which its fluids are ejected upon motion of the piston in said chamber;

f. a mixer connected to said dispenser, said mixer having an input end and a discharge end;

g. said ports being located closely adjacent said input end of said mixer.

h. the first of said chambers fitting telescopically into the second of said chambers and provided with a portion which engages the piston of said second chamber, whereby motion of said first chamber moves said piston within said second chamber; and i. said second chamber having secured thereto a member which engages the piston on said first chamber, whereby said motion of said first chamber also causes said last named piston to move within said first chamber.

3. A dispenser as in claim 2 in which a sealing member is interposed between each piston and its chamber and is adapted to prevent leakage of th fluid in said chamber around said piston as it moves through its chambers.

4. A dispenser as in claim 2 in which said member secured to said second chamber comprises a conduit extending through the piston of said first chamber, and conduit being provided with an inlet opening into said first chamber and an outlet comprising the exit port of said chamber.

5. A dispenser as in claim 4 in which a valve member comprising a sealing member, is interposed between said conduit and said second chamber intermediate said exit ports, said sealing member yieldable under pressure from the fluid in said second chamber to open the exit port of said second chamber to permit passage of said last named fluid into the mixer.

6. A dispenser as in claim 2 in which said first chamber is completely removable with its piston from said second chamber, said piston being provided with an opening through which said first chamber may be filled with its fluid, said opening being provided with a removable sealing member adapted to be removed immediately prior to the assembly of said first chamber with said second chamber.

7. A dispenser as in claim 6 in which said thrust member comprises an elongated hollow conduit, the outer end of which is adapted to fit tightly into the opening in the piston of said first chamber when it is assembled with said second chamber, said conduit having a stop which engages the exterior of said latter piston whereby a thrust is exerted between said conduit and said latter piston as said chambers are forced together.

* * * * *